United States Patent [19]

Stalder et al.

[11] Patent Number: 4,640,089

[45] Date of Patent: Feb. 3, 1987

[54] METHOD AND DEVICE FOR SPINNING A YARN IN ACCORDANCE WITH THE OPEN END-FRICTION SPINNING PRINCIPLE

[75] Inventors: Herbert Stalder, Kollbrunn; Josef Baumgartner, Sirnach; Arthur Würmli, Winterthur, all of Switzerland

[73] Assignee: Rieter Machine Works, Winterthur, Switzerland

[21] Appl. No.: 883,373

[22] Filed: Jul. 8, 1986

[30] Foreign Application Priority Data

Jul. 12, 1985 [CH] Switzerland ..... 21/85

[51] Int. Cl.[4] ..... D01H 7/898; D01H 7/892

[52] U.S. Cl. ..... 57/401; 57/408; 57/411

[58] Field of Search ..... 57/400, 401, 408, 409, 57/411, 413

[56] References Cited

U.S. PATENT DOCUMENTS

| | | | |
|---|---|---|---|
| 4,107,909 | 8/1978 | Fehrer et al. | 57/401 X |
| 4,567,722 | 2/1986 | Stahlecker | 57/401 |
| 4,571,932 | 2/1986 | Stahlecker et al. | 57/401 |
| 4,574,581 | 3/1986 | Stahlecker | 57/401 |
| 4,584,832 | 4/1986 | Stahlecker | 57/401 |

FOREIGN PATENT DOCUMENTS

| | | |
|---|---|---|
| 3300636 | 7/1984 | Fed. Rep. of Germany . |
| 3318924 | 11/1984 | Fed. Rep. of Germany . |
| 3324001 | 1/1985 | Fed. Rep. of Germany . |
| 3323189 | 1/1985 | Fed. Rep. of Germany . |
| 1231198 | 5/1971 | United Kingdom . |

*Primary Examiner*—Donald Watkins

*Attorney, Agent, or Firm*—Werner W. Kleeman

[57] ABSTRACT

Fibers delivered in a freely floating state in a fiber transport passage are to be laid in a predetermined disposition on a friction spinning element, such as a friction spinning drum or disc. For this purpose, an opening region of the fiber transport passage is provided with a converging portion in which the airstream is supplementarily accelerated relative to a preceding acceleration. This supplementary acceleration serves to assist in bringing the fibers into the predetermined disposition on the friction spinning drum. The friction spinning device comprises an opening roller which is rotatably supported in a housing. The housing is connected to the fiber transport passage. The opening of the fiber transport passage extends close to a cylindrical surface of the friction spinning drum. The fibers leaving the opening are transported on the friction spinning drum towards a yarn formation position where they are twisted into a yarn which is withdrawn in a selectable withdrawal direction by withdrawal rollers.

31 Claims, 10 Drawing Figures

2
1
I
Z
3
100
4
5
17
6
I
16
3.1
N
S
3.2
U
14.1
α
A
11
S.1
γ
M
a
B
13
14
12
52
P

II
6
U
D.3
D.2
D.1
L
14
14.1
15
II 2
1
Z
5.1
T
6
14.1
11
M
U
A
13
B
14
12
52
P 1
2
6
D.1
5.1
18
D.3
D.2
U
Z
100
19
A
U
14
12
14.1
15

METHOD AND DEVICE FOR SPINNING A YARN IN ACCORDANCE WITH THE OPEN END-FRICTION SPINNING PRINCIPLE

CROSS REFERENCE TO RELATED APPLICATION

The application is related to the commonly assigned: U.S. Pat. Application Ser. No. 06/734,845, filed May 15, 1985 and entitled "METHOD AND APPARATUS FOR PRODUCING A YARN", U.S. Pat. Application Ser. No. 06/773,998, filed Sept. 9, 1985 and entitled "METHOD AND APPARATUS FOR THE PRODUCTION OF A YARN", and U.S. Pat. Application Ser. No. 06/789,902, filed Oct. 10, 1985, entitled "METHOD OF, AND APPARATUS FOR, PRODUCING A YARN AND FRICTION SPUN YARN PRODUCED BY SUCH METHOD OR APPARATUS", and U.S. Pat. Application Serial No. 06/874,522, filed 6/16/86, and entitled "FRICTION SPINNING DEVICE CONTAINING A FRICTION SPINNING MEANS AND METHOD OF USE OF THE FRICTION SPINNING DEVICE.

BACKGROUND OF THE INVENTION

The present invention broadly relates to the spinning of yarn or the like according to the open end-friction spinning principle.

Generally speaking, the method of the present invention is for spinning a yarn or the like in accordance with the open end-friction spinning principle and comprises the steps of separating fibers from a body of fibers, transporting the fibers in a freely floating state by means of a pneumatic fiber transporting airstream guided in a fiber transport passage or channel in a direction of movement inclined at a predetermined acute angle to the opening of the transport passage, subsequently transferring the fibers to a moving perforated surface of a friction spinning means or element which is subjected to underpressure or vacuum, the friction spinning means or element being arranged to intercept the pneumatic fiber transporting airstream, the moving perforated surface being arranged to permit the pneumatic fiber transporting airstream to pass through the moving perforated surface, employing the friction spinning means for forming the fibers into a yarn at a yarn formation position or location, and withdrawing the formed yarn in a predetermined withdrawal direction.

The apparatus of the present invention is for performing a method for spinning a yarn and comprises means for separating fibers from a body of fibers, a friction spinning means or element having a perforated surface defining a yarn formation position or location, a fiber transport passage or channel having an exit opening situated substantially parallel to and at a predetermined spacing from the yarn formation position or location, the fiber transport passage or channel being arranged to forward the fibers pneumatically to the perforated surface for forming the fibers into a yarn, and a yarn withdrawing means for withdrawing the formed yarn.

From previous publications regarding the open end-friction spinning method, it is known to open a fiber sliver to form individual fibers by means of an opening roller known from the open end-rotor spinning method. These fibers are combed from the sliver by needles or teeth of the opening roller, which rotates at high speed.

The fibers are transferred to a transporting airstream for transport to a friction spinning means or element.

The fibers in the transporting airstream are in a disordered or random state and are not stretched-out or extended. Delivering the fibers to the friction spinning means in this state, presents poor initial conditions for spinning a yarn of usable quality.

One proposal for delivering fibers in a drawn-out or extended state or condition is advanced in German Patent Publication, No. 3,324,001, published Jan. 3, 1985. In that proposal, obstacles, for example in the form of needles inclined in the fiber transport direction, are provided in the transport passage; the fibers are temporarily caught or at least braked by these obstacles. The fibers are then drawn out or extended by the airstream so as to be delivered in this drawn-out or extended state for subsequent formation of a yarn.

The disadvantage of such obstacles lies primarily in the risk that relatively large fiber clumps or conglomerations at least temporarily will form on the obstacles.

Such fiber clumps may then dislodge and be transported onwards as a unit and may then be supplied to the forming yarn end, resulting in unacceptable neps in the yarn. Another risk lies in the possibility of at least partial blockage of the transport passage or channel.

Another proposal for delivering fibers in a drawn-out or extended state, and in as parallel as possible a state or condition, into the convergent space between two friction spinning drums is set forth in German Patent Publication, No. 3,318,924, published Nov. 29, 1984. In that proposal, a slot-shaped fiber feed passage has a bulge in the region of its exit opening in the wall lying opposite the convergent space; this bulge is intended to provide the possibility for fibers delivered in a drawn-out or extended form or state to be caught at their front or leading ends by the yarn end in the convergent gap and withdrawn in the opposite direction and then to be laid parallel upon the forming yarn end in a whip-like manner with a so-called centrifugal-drawing or acceleration extension movement, so that thereafter they may be twisted into a yarn. In this arrangement, the fiber transport passage lies substantially in a plane extending through the converging gap and at right angles to the axes of the friction spinning drums or rollers. Furthermore, the fiber transport passage is inclined at an acute angle and opposite to the withdrawal direction of the yarn, for example at an angle of approximately 30° .

The disadvantage of this apparatus is that, after the front ends of the drawn-out or extended fibers have been caught by the yarn end, these fibers are diverted at the withdrawal speed of the yarn, which is relatively low compared with the fiber transport speed in the fiber transport passage, so that the trailing portion of a fiber is diverted only partially in a whip-like fashion, while the remaining portion of this fiber is subjected to longitudinal compression in the convergent gap.

Additional technology in this regard is illustrated and described in the U.S. Pat. application Ser. No. 06/773,998, filed Sept. 9, 1985, and entitled "METHOD AND APPARATUS FOR THE PRODUCTION OF A YARN", in which the fibers are delivered neither parallel nor at right angles to the yarn end but in a condition intermediate these two dispositions, so that thereafter they are twisted into the yarn end at the yarn formation position or location and are withdrawn as a yarn.

The disadvantage is, however, that in the aforementioned device of this copending United States application the irregularity with which the fibers adopt the abovementioned desired disposition is too great.

SUMMARY OF THE INVENTION

Therefore, with the foregoing in mind, it is a primary object of the present invention to provide a new and improved method and apparatus for spinning yarn which do not exhibit the aforementioned drawbacks and shortcomings of prior art constructions.

A further object of the present invention is to deliver fibers to a friction spinning means without the risks of blockage and longitudinal fiber compression, and in a substantially drawn-out or extended state or disposition of the fibers.

Yet a further significant object of the present invention aims at providing a new and improved construction of an apparatus of the character described for spinning yarn which is relatively simple in construction and design, extremely economical to manufacture, highly reliable in operation, not readily subject to break down or malfunction and requires a minimum of maintenance and servicing.

Now in order to implement these and still further objects of the present invention which will become more readily apparent as the description proceeds, the method of the present invention is manifested by the features that it comprises the steps of separating fibers from a body of fibers, transporting the fibers in a freely floating state by means of a pneumatic fiber transporting airstream guided in a fiber transport passage or channel in a direction of fiber movement which is inclined at a predetermined acute angle to the exit opening of the fiber transport passage, subsequently transferring the fibers to a moving perforated surface of a friction spinning means which is subjected to underpressure or vacuum, employing the friction spinning means for forming the fibers into a yarn at a yarn formation position or location, and withdrawing the formed yarn in a predetermined withdrawal direction. The friction spinning means are arranged to intercept the pneumatic fiber transporting airstream and the moving perforated surface is arranged to permit the pneumatic fiber transporting airstream to pass through the moving perforated surface. Importantly, the pneumatic fiber transporting airstream is supplementarily accelerated in a predetermined zone or region terminating at the exit opening and such predetermined region or zone having a predetermined height.

The apparatus of the present invention is manifested by the features that the fiber transport passage or channel has immediately before the exit opening a region with a predetermined height measured at right angles from the exit opening and in which region the fiber transport passage or channel exhibits steeper convergence than before this region and the convergence in this region has a predetermined angle.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
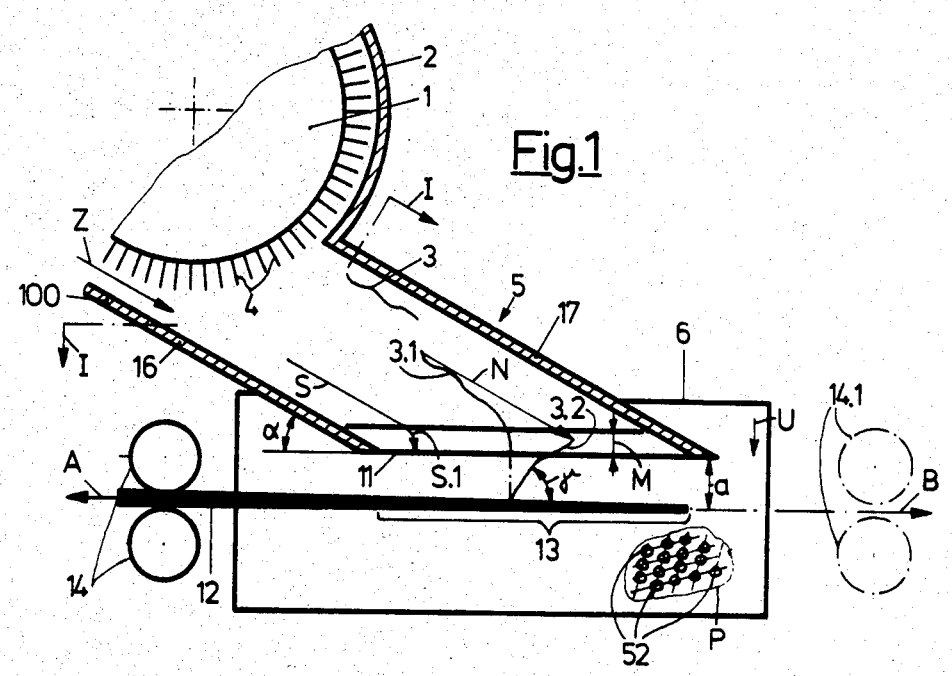
FIG. 1 shows a longitudinal section through a friction spinning device according to the invention, illustrated schematically and in partial section.

Describing now the drawings, it is to be understood that to simplify the showing thereof only enough of the structure of the different embodiments of friction spinning apparatuses or devices has been illustrated therein as is needed to enable one skilled in the art to readily understand the underlying principles and concepts of this invention. Turning specifically to FIG. 1 of the drawings, the friction spinning apparatus or device illustrated therein by way of example and not limitation and employed to realize the method as hereinbefore described will be seen to comprise an opening roller 1 known from open-end rotor spinning techniques. The opening roller 1 is drivable and is supported in conventional manner in an only partially illustrated housing 2. This opening roller 1 is also provided in conventional manner and thus here not further described, with needles 4 or nor particularly shown conventional teeth for separating or opening a not particularly shown conventional fiber sliver into individual fibers 3.

Figure 5:
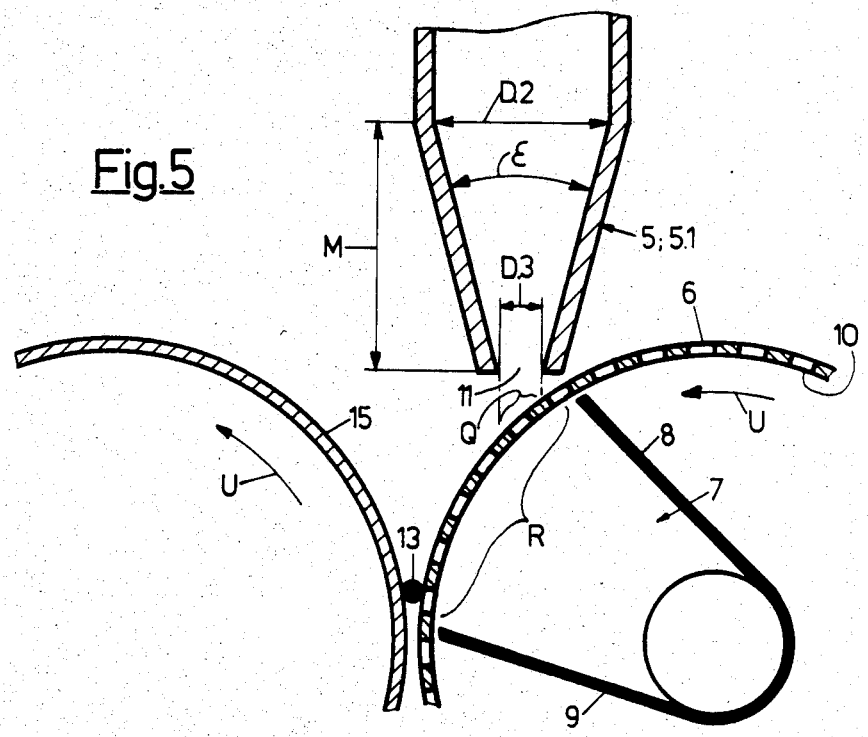
FIG. 5 shows a detail section of the friction spinning device according to the invention taken along the line II—II in FIG. 2 but on an enlarged scale.

The housing 2 is connected to a fiber feed or transport passage or channel 5 which has an exit opening 11 situated close to the cylindrical surface of a perforated friction spinning drum 6, defining a friction spinning element,. as can be particularly seen in FIG. 5.

This friction spinning drum 6 has in its interior a suction duct 7 (cf. FIG. 5), which defines by means of its walls 8 and 9 a suction zone R at the periphery of the friction spinning drum 6. In this arrangement, the walls 8 and 9 extend so close to the cylindrical internal wall 10 of the friction spinning drum 6, without contacting the internal wall 10, that inflow of leakage or false air between the walls 8 and 9 and the interior wall 10 is practically prevented.

By means of the air drawn in by the suction duct 7, and also flowing through the fiber feed passage or channel 5, the fibers 3 released by the needles 4 and while floating freely in the transport passage 5 are caught, as later region Q of the rotating friction spinning drum 6, which region Q is defined by the exit opening 11—also called simply opening 11—of the transport passage or channel 5. Finally, the fibers are twisted into a yarn 12 at a yarn formation position 13 or location.

This yarn formation position 13 is located in the region of an imaginary extension of the wall 9 of the suction duct 7 through the cylindrical wall of the friction spinning drum 6, that is in the boundary region within the suction zone R defined by the wall 9.

The friction spinning drum 6 rotates in the direction indicated by the arrow U, and thereby transports the fibers delivered in the surface region Q on the friction spinning drum 6 into the yarn formation position or location 13.

The spun yarn 12 is withdrawn by a withdrawal roller pair 14 in a yarn withdrawal direction A. As can equally well be seen from FIG. 1, the withdrawal roller pair 14 can be provided at the opposite end face of the friction spinning drum 6, as illustrated by the dash-dotted roller pair 14.1; this implies that the yarn could also be withdrawn in the opposite yarn withdrawal direction B.

The not particularly illustrated length of the suction zone R, as viewed in the direction of the yarn formation position 13, substantially corresponds to at least the length L (cf. FIG. 2) of the exit opening 11. The length L and the free breadth or width D.3 (cf. FIGS. 2, 4 and 5) of the exit opening 11 define the cross-section of the exit opening. In this context, the expression "cross-section of the exit opening" refers to the exit cross-section of the fiber transport passage 5 or channel.

FIG. 1 also shows the fiber transport passage 5 with an inclination characterized by an acute angle $\alpha$. The angle of inclination $\alpha$ is defined between an imaginary extension of the exit opening 11 and a lower wall 16 (as viewed in FIG. 1) of the fiber transport passage 5. Furthermore, the exit opening 11 extends substantially parallel to, and is situated at a predetermined spacing a from, the yarn formation position 13.

Provided that the opposite upper wall 17 of the fiber transport passage 5 is substantially parallel to the lower wall 16, then the airstream in the fiber transport passage 5 also assumes an inclination at least similar to the exit opening cross-section.

Figure 2:
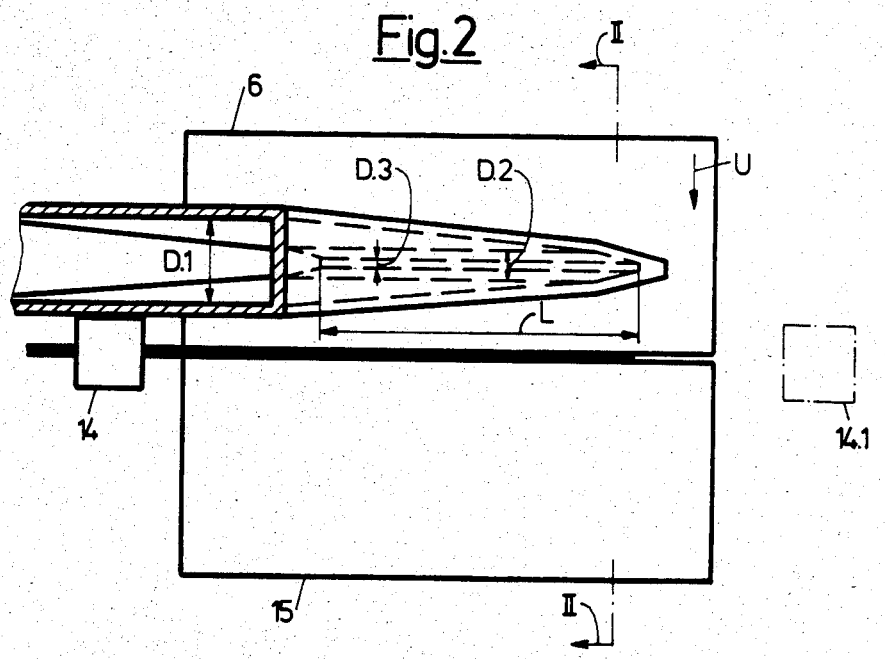
FIG. 2 shows a sectional partial plan view of the friction spinning device of FIG. 1 taken along the section line I—I.

Furthermore, FIG. 1 shows that the fiber transport passage 5 has in the region of its exit opening 11 a strongly convergent portion with the height M. As illustrated in FIGS. 2 and 5, this convergent portion converges from the passage width D.2 to the passage width D.3 of the fiber transport passage 5. The upstream portion of the fiber transport passage 5 also converges, but to a significantly lesser extent, as illustrated in FIG. 2 by the change from the passage width D.1 to the passage width D.2.

In operation, the fibers separated from the not particularly shown conventional fiber sliver by the needles 4 or the like of the opening roller 1 are taken up by the airstream Z (as will later be described in more detail) flowing past the needles 4 substantially tangentially to the opening roller 1. These fibers are transported onwards as freely floating fibers 3 in the fiber transport passage or channel 5. The airstream in the fiber transport passage or channel 5 is designated by the reference character S.

This airstream S is accelerated i.e. supplementarily accelerated in the convergent exit opening region of height M, corresponding to the change in cross-section defined by the change in the free width of the fiber transport passage 5 from the passage width D.2 to the passage width D.3. Thereafter, the fibers are taken up by the perforated friction spinning drum 6 in the region confronting the suction duct 7 (see FIG. 5).

In this acceleration zone, the airstream S is subjected to a diversion towards the cylindrical surface of the perforated friction spinning drum 6, as indicated by the curve S.1 of the arrow S. Hence, the front fiber portion, that is the fiber portion leading in the direction of flow, of a fiber 3 being delivered in such direction of flow and within such acceleration zone is also diverted in correspondence with the airstream S, and such front end of the fiber 3 is thereafter caught by the friction spinning drum 6 (as represented by the fiber orientation or condition 3.1) and is withdrawn in the longitudinal direction of the friction spinning drum 6. The trailing portion of this fiber 3 is transported further in the airstream S in the direction of the arrow N (cf. FIG. 1), and is finally delivered in a fiber orientation or disposition designated by the reference numeral 3.2 to the cylindrical surface of the friction spinning drum 6.

In this connection, the size of the angle $\gamma$ (cf. FIG. 1) defining the last-mentioned fiber disposition is dependent, on the one hand, on the relationship of the speed of flow of the air before or upstream of the region of the height M of the exit opening 11 to the peripheral speed of the friction spinning drum 6 while, on the other hand, the magnitude of this angle $\gamma$ is also dependent upon the height M itself, upon the supplementary or additional acceleration of the air in the previously mentioned region of the exit opening 11, and upon the angle of inclination $\alpha$ of the fiber transport passage or channel 5. For example, the angle $\gamma$ will be smaller if angle $\alpha$ becomes smaller, provided that the relationship between air speed and peripheral speed of the friction spinning drum 6 is sufficiently high, that the height M is adapted to the inclination of the fiber transport passage or channel 5 and that the supplementary acceleration in the region of the exit opening 11 is sufficiently great in order to divert the exit leading end of the respective fiber 3 sufficiently rapidly suddenly towards the cylindrical surface of the friction spinning drum 6. Basically, as the angle $\alpha$ becomes smaller, the relationship between air speed and peripheral speed of the friction spinning drum 6 must be increased and the supplementary acceleration in the region of the exit opening 11 must be increased due to the correspondingly lower selected value for the height M.

In practice, it has been found that the speed of the transporting air at the exit opening 11 must be at least 50% greater than the speed of the transporting air at the start of the region where the fiber transport passage 5 has a width D.2 in order to provide a sufficiently effective diversion of a leading end of the fiber 3.

Furthermore, the height of the convergent region before the exit opening 11 should not be greater than the length of the leading end of a fiber 3 taken up by this region —at the most, one third of the length of the average fiber 3 to be processed. The height M of the convergent region is therefore advantageously selected between 5 and 15 millimeters.

Furthermore, it has been established that the speed of the transporting air in the exit opening 11 should not exceed five times the speed at the region where the fiber transport passage width is D.2, that is at the start of this region. Advantageously, the speed of the transport air in the exit opening 11 lies between twice and four times the speed in the region where the fiber transport passage width is D.2.

On the other hand, it is essential that the speed of the airstream before or upstream of the convergent region be greater than the speed of movement of the friction spinning means or element, in order to avoid a situation in which the fibers 3 come to lie substantially in the direction of movement of the friction spinning means, that is extending in the peripheral direction of the friction spinning drum 6 or in the direction of rotation of a friction spinning disc 30 (see FIG. 6), as the case may be.

In a similar manner, it can be shown that the speed of the transporting airstream before or upstream of the convergent region must increase as the angle of inclination $\alpha$ of the fiber transport passage 5 (see FIG. 1) or 5.1 (see FIGS. 3 and 6) decreases, in order to bring the fibers 3 into the fiber orientation or disposition 3.2 with the desired angle $\gamma$. For example, if the angle of inclination $\alpha$ of the fiber transport passage 5 lies between 30° and 10°, the air speed should lie between 15 meters per second and 100 meters per second.

The angle of inclination $\gamma$ of the fibers 3 in the fiber orientation or disposition 3.2 is also reduced if the speed of the airstream before the convergent region is increased while the speed of movement of the friction spinning means remains constant. At the minimum, the speed of the airstream must be twice as great as the speed of movement of the friction spinning means.

The angle $\xi$, which characterizes the degree of convergence of the convergent region, should be selected between 20° and 50°, preferably between 30° and 40°, in order to obtain the desired, previously-mentioned fiber deposition effect without excessive flow losses.

Figure 9:
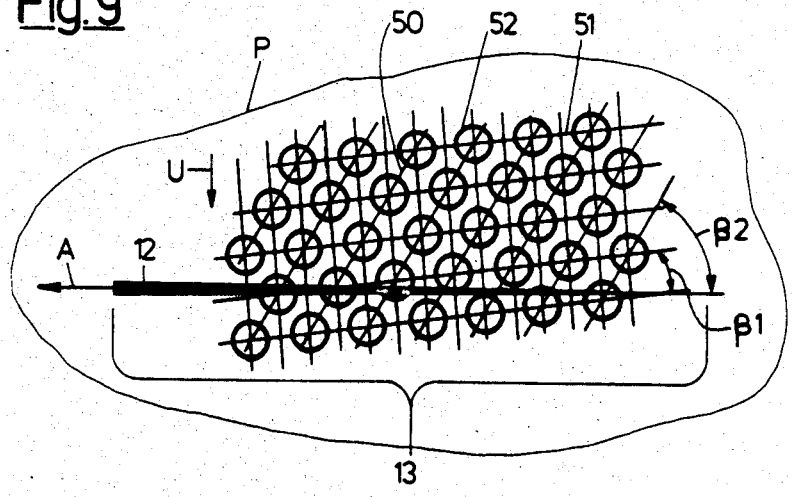
FIGS. 9 and 10 schematically show respective portions of the friction spinning devices of FIGS. 1, 3 and 8 on an enlarged scale.

Furthermore, as illustrated in FIG. 9, the arrangement of holes 52 providing the perforation of the surface of the frictions spinning means—in this case the cylindrical surface of the friction spinning drum 6—should be selected such that the connecting lines 50 and 51 form an acute angle, the connecting lines 50 and 51 being those lines connecting hole centers which lie in an orientation or disposition inclined to the yarn formation position 13 at the respective angles $\beta 1$ and $\beta 2$. The larger angle $\beta 2$ should not be greater than 80°, and the smaller angle $\beta 1$ should not be less than 5°. Preferably, the smaller angle $\beta 1$ is selected between 10° and 30°, since most fibers are deposited with this fiber disposition angle $\gamma$. Furthermore, the connecting lines 50 and 51 are provided with an inclination to the yarn formation position 13 which is opposite to that of the fiber transport passage 5 or 5.1.

It has also been established that the fibers have the tendency to lie along rows of holes on the perforated friction spinning means. This effect can be explained by the fact that the intensity of the airstream of each individual hole 52 is such that the air is able to force a fiber onto either one or another of adjacent rows of holes so that very few fibers come to rest on the friction spinning means in the regions between the rows of holes.

However, in order to obtain in practice the fiber orientation or disposition 3.2 for the fibers on the friction spinning means with the abovementioned method, the rows of holes are arranged in a disposition or distribution corresponding to this fiber orientation or disposition 3.2. In order to avoid inadvertent supply of fibers parallel to the yarn formation position or location 13, or even at right angles thereto, the rows of holes 52 are arranged such that the H straight lines 50 and 51 joining the hole centers are arranged neither parallel to the yarn formation position 13 nor at a right angle thereto.

Figure 3:
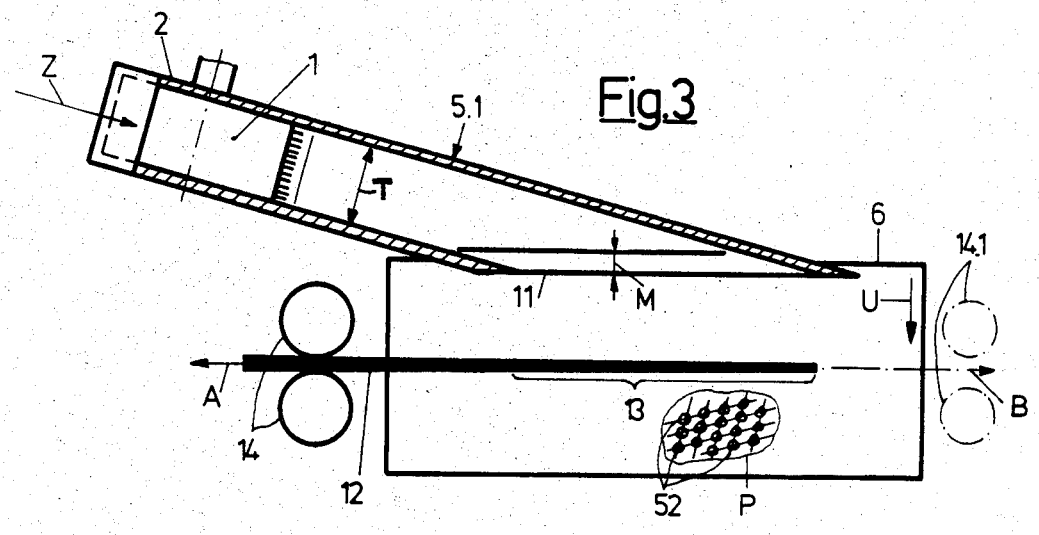
FIG. 3 shows a modification of the friction spinning device of FIG. 1.
Figure 4:
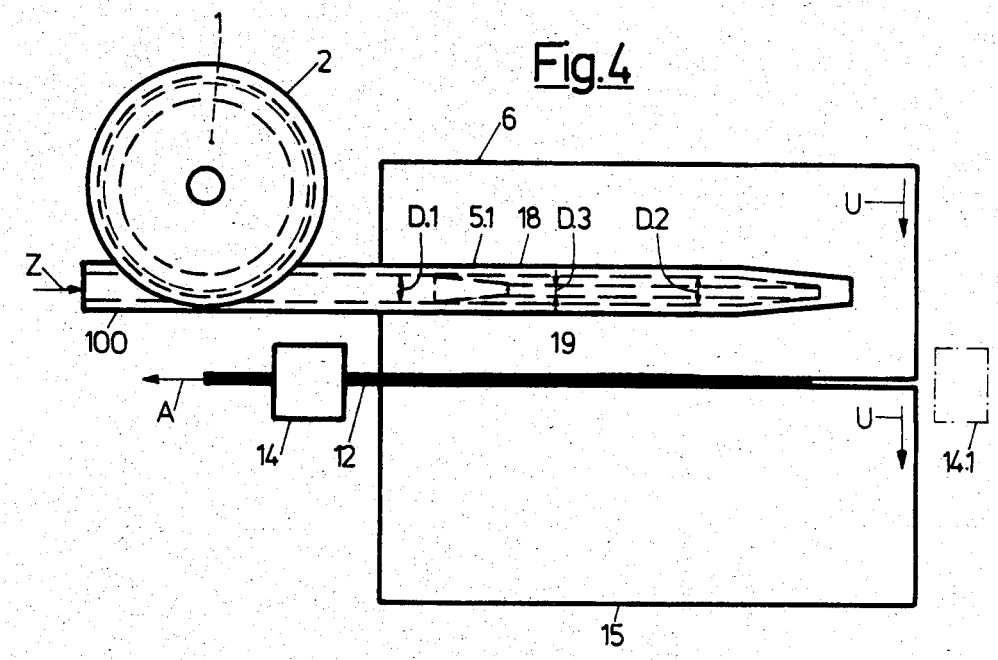
FIG. 4 shows a plan view of the friction spinning device of FIG. 3.

The friction spinning device of FIGS. 3 and 4 differs essentially from that of FIGS. 1 and 2 by the disposition or spatial relation of the opening roller 1 relative to that of the exit opening 11, and also by the substantially parallel lengths or extents of the walls 18 and 19 of the fiber transport passage 5.1 defining the passage widths D.1 and D.2. Accordingly, elements with the same functions as those described for the friction spinning device of FIGS. 1 and 2 are indicated by the same reference numerals.

The fiber transport passage or channel 5.1 of the friction spinning device of FIGS. 3 and 4 has, in principle, the same function as the fiber transport passage 5 of the friction spinning device of FIGS. 1 and 2; nevertheless, since the walls 18 and 19 extend substantially parallel to one another, the fiber transport passage in the device of FIGS. 3 and 4 is designated by the reference numeral 5.1.

In the friction spinning device of FIGS. 1 and 2, the passage width D.1 corresponds to the not particularly illustrated breadth or width of the opening roller 1, while the passage width D.1 of the fiber transport passage 5.1 of the friction spinning device of FIGS. 3 and 4 can be selected independently of the breadth or width of the opening roller 1 since in this variant, said breadth or width defines the width T of the fiber transport passage 5.1.

Figure 6:
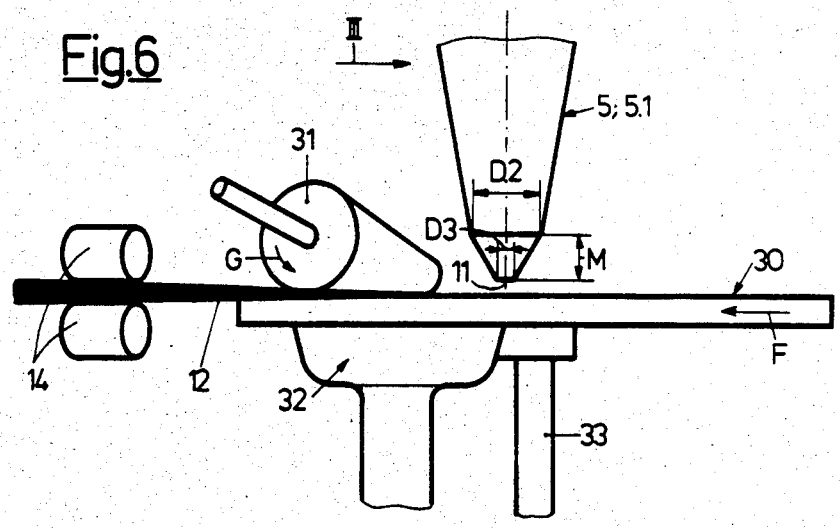
FIG. 6 shows a schematic partial view of a further construction of friction spinning device according to the invention.
Figure 7:
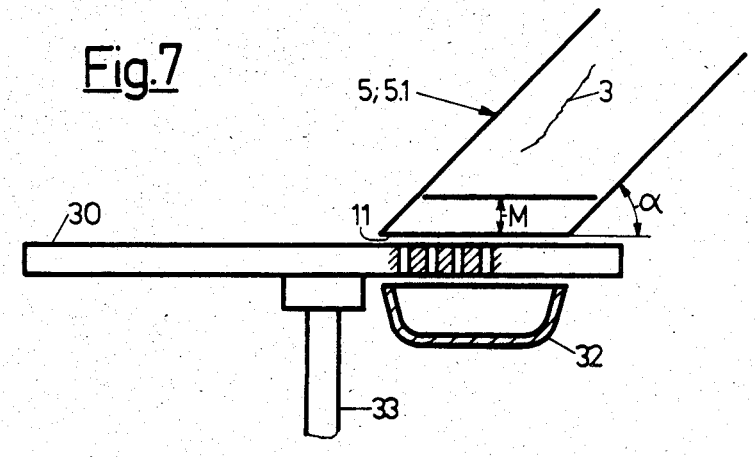
FIG. 7 shows a part of the friction spinning device of FIG. 6 viewed in the direction of the arrow III in FIG. 6.
Figure 8:
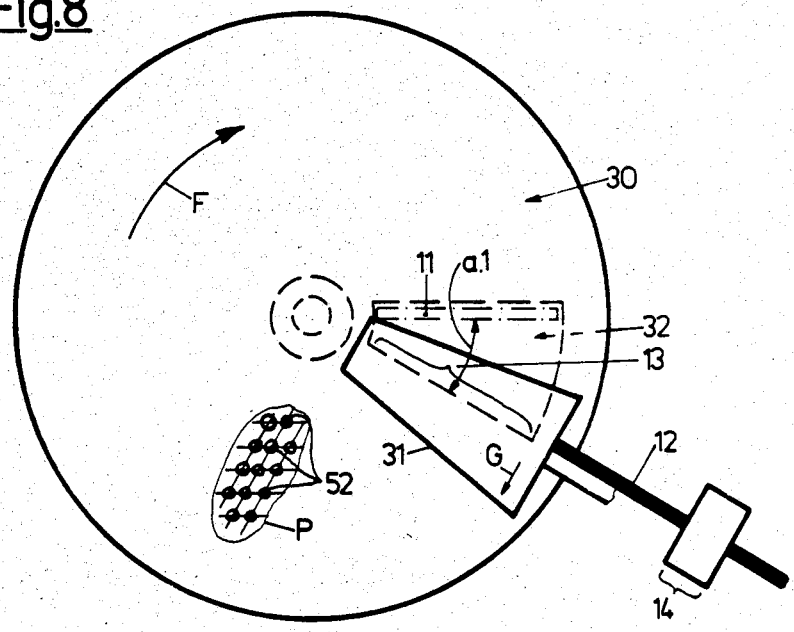
FIG. 8 shows a plan view of a portion of the friction spinning device of FIG. 6.

FIGS. 6 to 8 show the use of the invention in a friction spinning device of a type known from British Patent Specification No. 1,231,198, published May 12, 1971. In that arrangement, the friction spinning disc 30 is provided in place of the friction spinning drum 6 of FIGS. 1 and 2, and a substantially conical counter-roller 31 is provided in place of a friction spinning drum 15, which would be provided in known manner as a counter-drum for the perforated friction spinning drum 6. The counter roller 31 rotates in the rotational direction F of an associated shaft 33 in order to forward into the yarn formation position or location 13 (cf. FIG. 8) those fibers 3 delivered by the fiber transport passage 5 or 5.1. The fibers 3 are twisted into a yarn 12 at the yarn formation position 13. The average spacing between the exit opening 11 and the yarn formation position 13 is designated by reference character a.1. The counter roller 31 rotates in the direction G. A suction duct 32, the suction opening of which is indicated with dash-dotted lines in FIG. 8, has the same function as the previously mentioned suction duct 7. The other elements with the same functions as those in the preceding figures are designated by the same reference numerals. FIGS. 6 and 7 indicate that the fiber transport passage 5 or 5.1 can be provided either in the manner illustrated in FIGS. 1 and 2 or in that illustrated in FIGS. 3 and 4.

Figure 10:
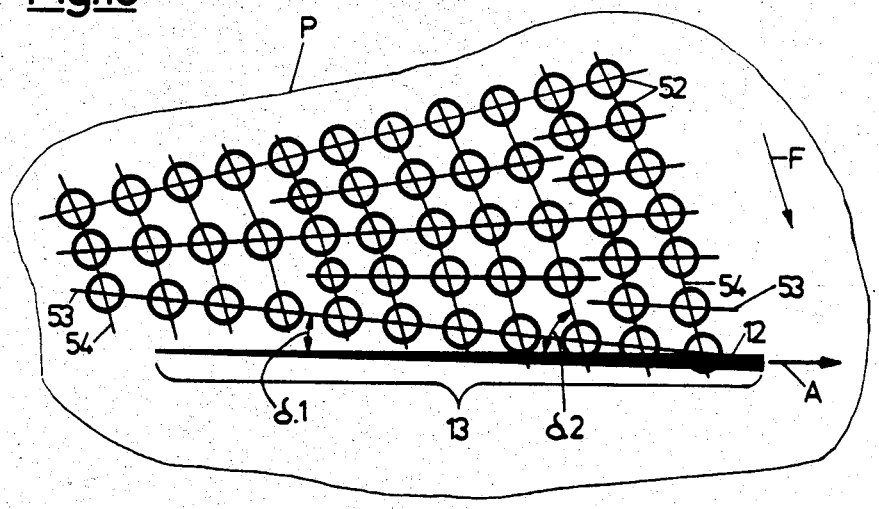

In FIG. 10 and in a manner similar to that described for FIG. 9, in this case, too, the holes 52 providing the perforations are so arranged that at least two of the straight lines joining the rows of holes define an acute angle with the yarn formation position 13. These lines are designated by the reference numerals 53 and 54, respectively, and the associated angles are designated by the reference characters $\delta.1$ and $\delta.2$, respectively. Since the arrangement involves a friction spinning disc rather than a friction spinning drum, it is clear that the arrangement of holes must be provided in a segmental configuration as illustrated in FIG. 10.

With reference to the formation of the yarn at the yarn formation position 13 from the fibers 3 in the fiber orientation or disposition 3.2, reference is made to the aforementioned commonly assigned U.S. Pat. application Ser. No. 06/773,998.

The previously mentioned airstream Z is guided within an air infeed passage 100 extending tangentially to the opening roller 1. As indicated in FIG. 1, this air infeed passage 100 extends along a straight line into the fiber transport passage or channel 5. It is, however, possible to arrange this air infeed passage at an angle to the fiber transport passage 5. The important point is that this air infeed passage 100 be so arranged that the airstream Z is able to take up the fibers 3 from the opening roller 1 and transfer them to the fiber transport passage 5. The provision of the previously mentioned air infeed passage 100 is not limited to use in a friction spinning device according to FIG. 1 but is possible in a similar fashion in all herein illustrated fiber transport passages or channels 5.

The advantage of such an air infeed passage 100, and thus of an airstream Z, lies in the possibility of achieving in a simple manner the quantity of air required to obtain the transport speed for the fibers 3 in the fiber transport passage 5. It is also advantageous that the air flowing past the opening roller 1 can thereby be arranged to flow with a speed which is at least equal to or greater than the peripheral speed of the outermost diameter of the opening roller 1, so that the airstream Z exerts a drawing or drafting effect on the fibers to be taken up from the opening roller. In this way, there is the possibility that the fibers 3 fed to the acceleration zone in the region of the exit opening 11 have already been subjected to drawing or drafting, so that substantially stretched-out or extended fibers can be provided in the fiber orientation or disposition 3.2.

In dependence upon the selected passage form, for example a continuously convergent passage form as illustrated in FIG. 2, the air flow S can be subjected to an additional or supplementary acceleration between the opening roller 1 and the acceleration region in the exit opening 11. Thus, the front or leading fiber ends, as viewed in the transport direction of the fibers guided in the fiber transport passage 5, are also subjected a higher speed of the surrounding air than the trailing ends. This also contributes to an additional drawing-out or extension of the fibers, or at least to avoidance of crimped or kinked formations at the fibers.

Additionally, due to the simple selection of the air quantity in $m^3$/min., i.e. of the flow rate the air speed in the fiber transporting passage or channel can be so selected that a desired thinning or rarefaction of the fiber flow in the fiber transport passage 5 can be achieved. This is useful for the previously mentioned diversion "somersaulting" of the fibers 3, since this somersault action becomes more effective with reduction of the number of fibers 3 in the fiber flow cross-section.

The quantity of air can be adjusted by changing the cross-section of the air infeed passage 100 or by changing the underpressure or vacuum in the fiber transport passage 5 or 5.1, respectively, or both.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A method for spinning a yarn or the like in accordance with the open end friction spinning principle, comprising the steps of:

separating fibers from a body of fibers;

transporting said fibers in a freely floating state by means of a pneumatic fiber transporting airstream guided in a fiber transport passage in a direction of movement inclined at a predetermined acute angle to an exit opening of said fiber transport passage;

accelerating said pneumatic fiber transporting airstream in a predetermined region which terminates at the exit opening of the fiber transport passage and which predetermined region has a predetermined height;

subsequently transferring said fibers to a moving perforated surface of a friction spinning means which is subjected to underpressure;

intercepting said pneumatic fiber transporting airstream by means of said friction spinning means;

passing said pneumatic fiber transporting airstream through said moving perforated surface;

employing said friction spinning means for forming said fibers into a yarn at a yarn formation position of the friction spinning means; and withdrawing said formed yarn in a predetermined yarn withdrawal direction.

2. The method as defined in claim 1, wherein:

said step of accelerating said pneumatic fiber transporting airstream entails accelerating said pneumatic fiber transporting airstream in said predetermined region and . diverting said pneumatic fiber transporting airstream towards said exit opening such that an end portion of a freely floating fiber which extends substantially at an acute angle towards said exit opening is engaged by said predetermined region and leads viewed in a direction of movement of the floating fibers, and said end portion of the engaged fiber is diverted from said direction of movement into an orientation which is more strongly directed towards said exit opening than an adjacent remaining portion of said engaged fiber and such that said engaged fiber is delivered in said orientation through said exit opening onto said moving perforated surface of said friction spinning means.

3. The method as defined in claim 1, wherein:

the speed of said pneumatic fiber transporting airstream before said predetermined region is greater than the speed of said moving perforated surface of said friction spinning means such that a trailing end portion of said fiber in said airstream is transported further in the direction of said airstream such that said fiber is finally deposited on the friction spinning means in an orientation in which said fiber defines said predetermined acute angle with said yarn formation position and is inclined to said yarn formation position with an inclination which is opposite to an inclination of said pneumatic fiber transport passage.

4. The method as defined in claim 1, wherein:

the height of said predetermined region decreases with a decrease in the angle of inclination of the direction of the fiber movement.

5. The method as defined in claim 1, wherein:

the speed of the pneumatic fiber transporting airstream in said exit opening is at least 50% greater than the speed of the pneumatic fiber transporting airstream at the start of said predetermined region.

6. The method as defined in claim 1, further including the steps of:

engaging in said predetermined region at most one-third of the length of an average fiber to be processed.

7. The method as defined in claim 1, wherein:

the speed of the pneumatic fiber transporting airstream in said exit opening increases to at most fives times the speed of the pneumatic fiber transporting airstream at the start of said predetermined region.

8. The method as defined in claim 1, wherein:

the speed of the pneumatic fiber transporting airstream in said exit opening increases to between twice and four times the speed of the pneumatic fiber transporting airstream at the start of said predetermined region.

9. The method as defined in claim 3, wherein:

the speed of said pneumatic fiber transporting airstream increases with a decrease in the angle of inclination of said fiber transport passage.

10. The method as defined in claim 9, further including the step of:

increasing the speed of said pneumatic fiber transporting airstream while maintaining the speed of movement of said friction spinning means constant.

11. The method as defined in claim 3, wherein:

the speed of said pneumatic fiber transporting airstream is at least twice the speed of movement of said friction spinning means.

12. The method as defined in claim 9, wherein:

the angle of inclination of said fiber transport passage lies between 30° and 10° when the speed of said pneumatic fiber transporting airstream lies between 15 m/sec. and 100 m/sec.

13. The method as defined in claim 1, wherein:

said step of separating said fibers entails taking up said separated fibers for drawing-out said fibers; and said pneumatic fiber transporting airstream having a speed which is at least equal to the speed of said fibers.

14. The method as defined in claim 1, wherein:

said step of separating said fibers entails taking up said separated fibers for drawing-out said fibers; and said pneumatic fiber transporting airstream having a speed which is greater than the speed of said fibers.

15. An apparatus for spinning a yarn or the like, comprising:

means for separating fibers from a body of fibers;

friction spinning means having a perforated surface defining a yarn formation position;

a fiber transport passage having an exit opening situated substantially parallel to and at a predetermined spacing from said yarn formation position;

said fiber transport passage being arranged to forward said fibers pneumatically to said perforated surface for forming said fibers into a yarn at said yarn formation position;

said fiber transport passage having immediately before said exit opening a region with a predeterminate height measured substantially at right angles with respect to said exit opening and in which region said fiber transport passage exhibits greater convergence than before said region;

said convergence in said region having a predeterminate angle; and a yarn withdrawing means for withdrawing said yarn formed at said formation position.

16. The apparatus as defined in claim 15, wherein:

said fiber transport passage is inclined at a predetermined acute angle with respect to said exit opening.

17. The apparatus as defined in claim 15, wherein:

the predeterminate angle of said convergence is between 20° and 50°.

18. The apparatus as defined in claim 15, wherein:

the predeterminate height of said convergence is between 5 and 15 millimeters.

19. The apparatus as defined in claim 15, wherein:

the predeterminate height and the predeterminate angle of said convergence are such that the speed of said pneumatic fiber transporting airstream in said exit opening is at least 50% greater than the speed of said pneumatic fiber transporting airstream before said region.

20. The apparatus as defined in claim 15, wherein:

said convergence is such that the speed of said pneumatic fiber transporting airstream in said exit opening increases to at most five times the speed of said pneumatic fiber transporting airstream at the start of said region.

21. The apparatus as defined in claim 15, wherein:

the predeterminate height of said convergence is governed by the angle of inclination of said fiber transport passage.

22. The apparatus as defined in claim 15, wherein:

the predeterminate angle of said convergence is governed by the angle of inclination of said fiber transport passage.

23. The apparatus according to clam 21, wherein:

the predeterminate height of said convergence decreases as a function of the angle of inclination as the angle of inclination decreases.

24. The apparatus as defined in claim 22, wherein:

the angle of said convergence increases as a function of the angle of inclination as the angle of inclination decreases.

25. The apparatus as defined in claim 15, wherein:

said perforated surface is provided with holes having centers joined by straight lines;

said holes being arranged such that said straight lines enclose an acute angle with said yarn formation position;

said straight lines being arranged at an inclination to said yarn formation position which is disposed opposite to an inclination of said fiber transport passage.

26. The apparatus as defined in claim 25, wherein:

said straight lines joining said centers of said holes enclose two angles of different magnitudes within the range of said acute angle enclosed by said straight lines.

27. The apparatus as defined in claim 26, wherein:

one of the angles is at most 80°.

28. The apparatus as defined in claim 26, wherein:

one of the angles is at least 5°.

29. The apparatus as defined in claim 26, wherein:

one of the angles is less than 30° and greater than 10°.

30. The apparatus as defined in claim 15, wherein:

said means for separating fibers from the body of fibers comprise an opening roller;

said fiber transport passage having an air infeed passage extending substantially tangentially relative to said opening roller; and said air infeed passage opening into said fiber transport passage.

31. The apparatus as defined in claim 30, wherein:

said air infeed passage opens into said fiber transport passage in a substantially straight line.

* * * * *